US006935833B2

(12) United States Patent
Seitz

(10) Patent No.: US 6,935,833 B2
(45) Date of Patent: Aug. 30, 2005

(54) RECIRCULATION STRUCTURE FOR TURBO CHARGERS

(75) Inventor: Peter Seitz, Bergkirchen/Guending (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 10/473,152

(22) PCT Filed: Feb. 26, 2003

(86) PCT No.: PCT/DE03/00623

§ 371 (c)(1),
(2), (4) Date: Apr. 12, 2004

(87) PCT Pub. No.: WO03/072910

PCT Pub. Date: Sep. 4, 2003

(65) Prior Publication Data

US 2004/0156714 A1 Aug. 12, 2004

(30) Foreign Application Priority Data

Feb. 28, 2002 (ZA) ..... 02/1688
Aug. 23, 2002 (DE) ..... 102 38 837

(51) Int. Cl.[7] ..... F01D 1/12
(52) U.S. Cl. ..... 415/58.1; 415/58.4; 415/914
(58) Field of Search ..... 415/58.1–58.8, 415/173.4, 174.3, 145–148, 119, 914

(56) References Cited

U.S. PATENT DOCUMENTS 3,011,762 A * 12/1961 Pouit ..... 415/109
3,620,640 A 11/1971 Soulez-Lariviere ..... 415/126
5,137,419 A 8/1992 Waterman ..... 41/170.1
5,282,718 A 2/1994 Koff et al. ..... 415/57.3
5,308,225 A * 5/1994 Koff et al. ..... 415/57.3
5,431,533 A * 7/1995 Hobbs ..... 415/58.7
5,474,417 A 12/1995 Privett et al. ..... 415/58.5
5,562,404 A * 10/1996 Koff et al. ..... 415/57.4
5,586,859 A * 12/1996 Nolcheff ..... 415/58.5
5,607,284 A * 3/1997 Byrne et al. ..... 415/58.5
5,762,470 A * 6/1998 Gelmedov et al. ..... 415/57.4
6,302,640 B1 10/2001 McKelvey ..... 415/58.5
6,585,479 B2 * 7/2003 Torrance ..... 415/58.5

FOREIGN PATENT DOCUMENTS

| | | |
|---|---|---|
| DE | 35 39 604 | 2/1987 |
| DE | 33 22 295 | 9/1990 |
| DE | 101 05 456 | 8/2002 |
| EP | 0 122 892 | 10/1984 |
| EP | 0 719 908 | 12/1995 |
| WO | WO 95/18922 | 1/1995 |

* cited by examiner

*Primary Examiner*—Edward K. Look
*Assistant Examiner*—Dwayne J. White
(74) *Attorney, Agent, or Firm*—Crowell & Moring LLP

(57) ABSTRACT

Recirculation structure for turbocompressors, having a ring chamber which is arranged in the area of the free blade ends of a blade ring largely upstream of the latter and adjoins the main flow duct. A plurality of guiding elements are arranged in the ring chamber distributed over its circumference and are arranged and shaped in a fluidically advantageous manner with respect to the recirculation flow, with recesses provided in the leading and/or trailing area of the ring chamber. The side of the ring chamber which adjoins the contour of the main flow duct is open along its axial length as well as along its entire circumference, the free edges of the guiding elements being situated on the or close to the contour of the main flow duct.

36 Claims, 3 Drawing Sheets

RECIRCULATION STRUCTURE FOR TURBO CHARGERS

BACKGROUND AND SUMMARY OF THE INVENTION

The invention relates to a recirculation structure for turbocompressors as well as to an aircraft engine and an industrial gas turbine having a ring chamber arranged concentrically with respect to compressor axis in an area of free blade ends of a blade ring, an axial center of the ring chamber being situated upstream of an axial center of the free blade ends, and the ring chamber radially adjoining a contour of a mian flow duct annulus, and having a plurality of guiding elements which are arranged in the ring chamber, are distributed along its circumference and are arranged and shaped such that in an axially trailing area of the ring chamber, entry of recirculation flow takes place in an advantageous manner with respect to the flow, and in an axially leading area of the ring chamber, exit of the recirculation flow relative to the downstream blade ring takes place in a defined direction and optionally with a define swirl, the guiding elements having recesses for the flow passage in the circumferential direction, in the leading and/or trailing areas of the ring chamber.

Recirculation structures for turbocompressors have been known for some time and, as a rule, are called "casing treatments" in the art. These primarily have the task of increasing the aerodynamically stable operating range of the compressor, in which case the so-called surging limit is displaced toward higher compressor pressures, that is, toward a higher compressor stress. The disturbances responsible for a local stall and, in the end, for the surging of the compressor, on the casing side, occur at the moving blade ends of one or more compressor stages and, on the hub side, at the radially interior guide blade ends because, in these areas, the aerodynamic stress is the highest. As the result of the recirculation of the "air particles" circulating between the blade tips at the rotational blade speed and having reduced energy into the main stream while the energy is increased, the flow in the area of blade ends is stabilized again. Since, as a rule, flow disturbances do not occur uniformly over the stage range, it should be possible to fluidically, achieve a compensation in the circumferential direction in addition to the essentially axial recirculation. The main disadvantage of the known "casing treatments" is the fact that, although they increase the surging limit, they equilaterally reduce the pressure coefficient.

German Patent Document DE 33 22 295 C3 protects an axial fan having a "casing treatment" of the above-mentioned type. A ring chamber (8) is illustrated there in which guiding elements (9) are fixedly arranged. In the downstream area over the running blade ends, an area is situated which is open in the circumferential direction and into which the guiding elements do not extend. A closed ring (7), which is aligned approximately with the contour of the main flow duct, is characteristic of this type of "casing treatment", which ring (7) separates the trailing entry area from the leading outlet area of the recirculation structure and forms a smooth closed surface area.

A very similar "casing treatment" is known from German Patent Document DE 35 39 604 C1, in which case, an area exists in the leading and trailing area of the ring chamber (7) which is open in the circumferential direction. The radially interior ring 6 should also be observed here.

A more novel "casing treatment" is known from U.S. Patent Document U.S. Pat. No. 5,282,718 A. Here, the ring chamber (18, 28) and the guiding elements (24) are fluidically refined. Here also, the inlet and the outlet of the recirculation flow are separated by a solid ring which is smooth and closed toward the blades. Such rings in the blade area, as a rule, have to be equipped with a grazing or abradable coating in the event of a contact with the blade tips.

Additional "casing treatments" with axial or axially diagonal grooves, are disclosed, for example, in U.S. Patent Document U.S. Pat. No. 5,137,419 A. These are not considered here because, in the absence of a mutual connection of the grooves, no flow compensation can take place in the circumferential direction in these versions.

In view of the disadvantages of the solutions according to the prior art, it is an object of the invention to provide a recirculation structure for turbocompressors, which permits clear increase of the surging limit and thus a clear enlargement of the stable operating range without any relevant impairment of the pressure coefficient.

The essence of the invention is the fact that the ring chamber with the guiding elements is completely open toward the main flow duct along its axial length and its circumference. Ring-type elements with grazing coatings, etc. are eliminated. The above-mentioned patent documents demonstrate that, up to now, the technical world had attempted to construct recirculation structures toward the main flow duct, that is, toward the so-called annulus, to be smooth, without gaps and closed along an axial area which is as large as possible in order to cause a lengthening of the contour of the main flow duct which is as favorable to the flow as possible and has low losses. In contrast, the invention results in gaps, fissured surfaces, etc. and therefore appears to be disadvantageous and in expedient. However, tests have shown that the recirculation structure according to the invention is superior to known solutions with respect to the rise of the surging limit as well as with respect to the efficiency. Aerodynamically, this can be explained in that the free and unforced forming of the recirculation flow in the open ring chamber with free standing guiding elements and flow connections in the circumferential direction is more important than a lengthening of the contour of the main flow duct which is as gap-free as possible. The absence of a closed ring has the additional advantages that no grazing or abradable (inlet) coating is required for the guiding elements, and radial space as well as weight are saved which results in structure-mechanical advantages.

Preferred embodiments of the recirculation structure according to the main claim are characterized in the subclaims.

The invention will be explained in detail in the following by means of the drawing.

DETAILED DESCRIPTION OF THE DRAWINGS

Figure 1:
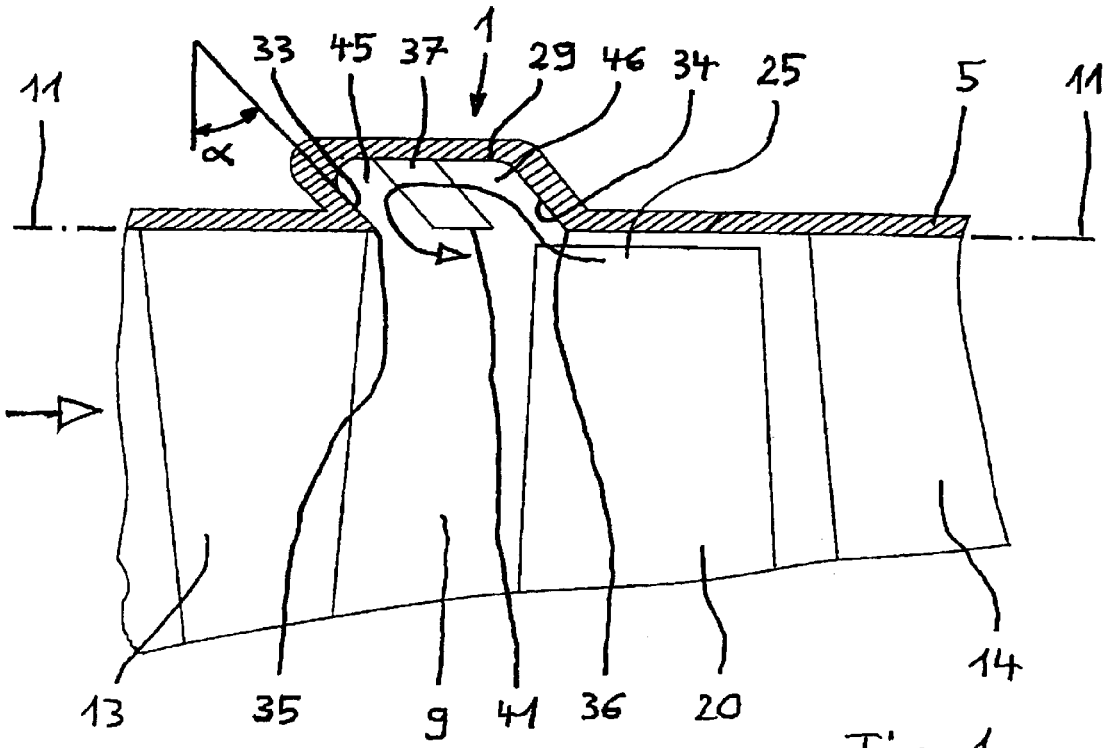
FIG. 1 is a partial longitudinal sectional view of a compressor in the axial construction in the area of a casing-side recirculation structure.

The recirculation structure 1 according to FIG. 1 is integrated in the casing 5 of a turbocompressor and is therefore called a "casing treatment". The flow direction in the bladed main flow duct 9 is indicated on the left by means of an arrow and therefore extends from the left to the right. In the illustrated area, the flow first encounters a guide blade ring 13, then a moving blade ring 20 and finally again a guide blade ring 14. The radially outer contour 11 of the main flow duct 9 corresponds to the inner contour of the casing 5 and, for a clear illustration, is continued in a dash-dotted manner on the left and right of the actual representation. The static recirculation structure 1 interacts with the running blade ring 20 and is situated largely axially in front of the latter, that is, upstream. The ring chamber 29 which, together with the guiding elements 37, forms the recirculation structure 1, adjoins the main flow duct 9 radially from the outside and is open in its direction. The free edges 41 of the guiding elements 37 are situated on or close to the contour 11 of the main flow duct 9; that is, they are at least approximately aligned with the inner contour of the casing. The guiding elements 37 may consist of a metal, such as an Ni base alloy, or of a light metal, such as Al, or of a plastic material, such as thermoplastics, duroplastics or elastomers. Starting from their radially interior edges 3, 36, the leading wall 33 and the trailing wall 34 of the ring chamber 29 are sloped forward in order to be fluidically advantageous for the recirculation indicated by a small arrow.

The angle of slope of the leading wall is marked by the letter $\alpha$; it may be identical or different in relation to the angle of the trailing wall 34. Recesses 45, 46 exist between the leading wall 33, the guiding elements 37 and the trailing wall 34, which recesses 45, 46 permit flow events within the ring chamber in the circumferential direction, in addition to the predominantly axially occurring recirculation. Reference number 25 indicates the free blade ends of the running blade ring 20 in whose area flow disturbances occur first.

Figure 2:
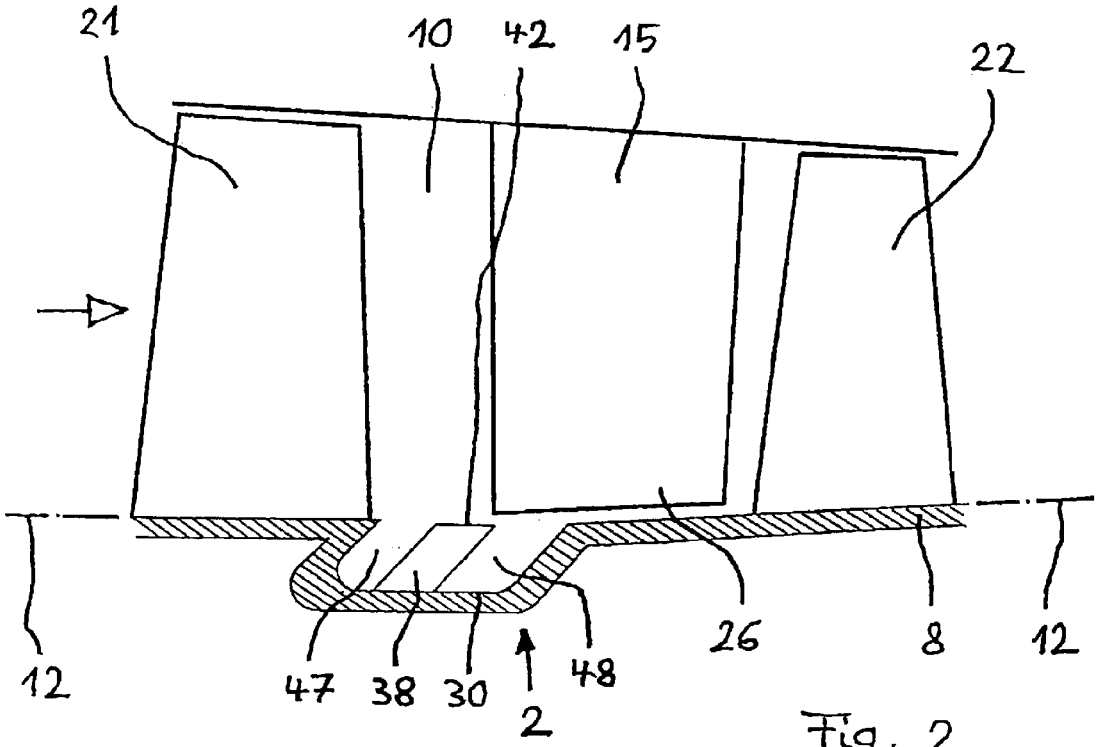
FIG. 2 is a comparable partial longitudinal sectional view in the area of a hub-side recirculation structure.

In contrast to FIG. 1, FIG. 2 shows a recirculation structure 2 integrated in a rotating hub 8. From the left to the right, a running blade ring 21, a guide blade ring 15 with radially interior, free blade ends 26 and a running blade ring 22 are visible in the main flow duct 10. Consequently, such a new arrangement of a recirculation structure should be called a "hub treatment". The recirculation structure 2, which consists of the ring chamber 30 and the guiding elements 38 and has leading and trailing recesses 47, 48, interacts with a guide blade ring 15 which, for the most part, is situated downstream. Since the "hub treatment" rotates in this case and the guide blade ring 15 stands still, the rotational rotor speed acts completely as a differential rotational speed. In principle, the method of operation does not differ from that of a "casing treatment". In a turbocompressor, the "casing treatment" and the "hub treatment" can also be combined and be used in several stages. Here, the radial inner contour 12 of the main flow duct corresponds to the outer contour of the hub 8.

Figure 3:
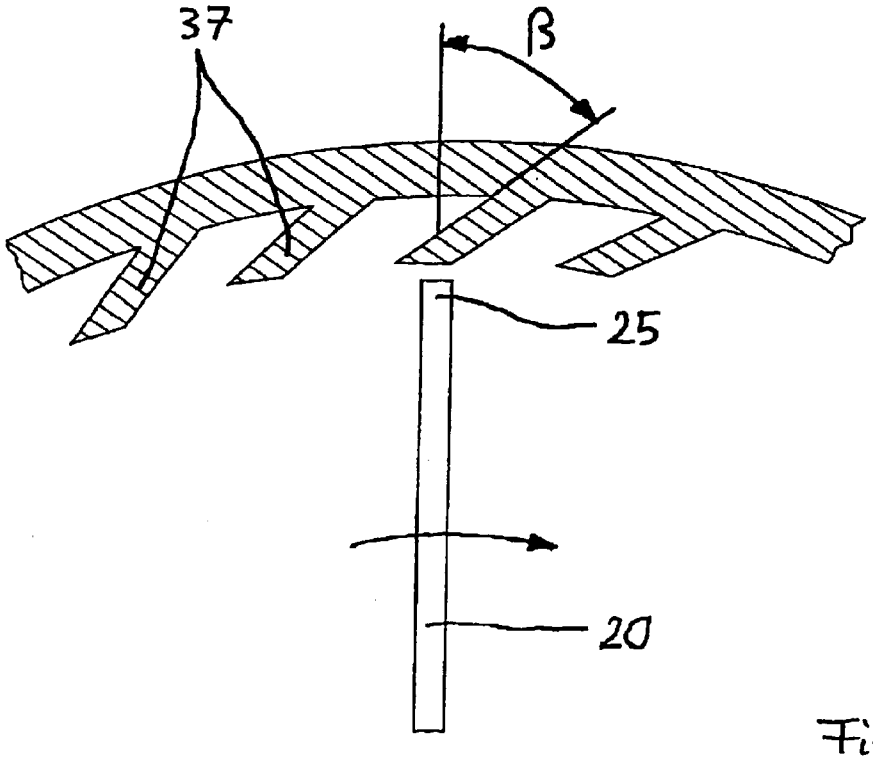
FIG. 3 is a partial cross-sectional view of the recirculation structure according to FIG. 1.

FIG. 3 is a cross-sectional view of a detail of FIG. 1. The guiding elements 37 are sloped by an angle $\beta$ with respect to the radial line such that the blade ends 25 of the running blade ring 20 deliver the recirculation flow without any major losses into the ring chamber 29, in which case the rotating direction (see arrow) should be observed. The angle of slope $\beta$ may diminish from the radial interior toward the exterior to the "zero" value while the guiding elements are correspondingly curved.

A radial arrangement of the guiding elements, that is, $\beta=0°$, is possible but would probably be less advantageous for the flow.

Figure 4:
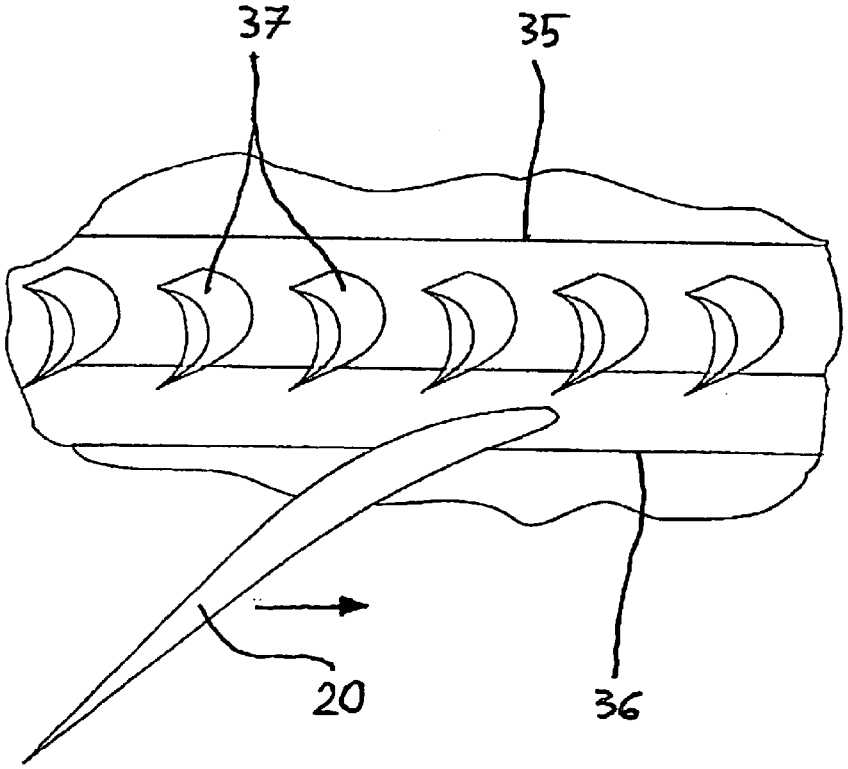
FIG. 4 is a partial view, radially from the interior, of the recirculation structure according to FIGS. 1 and 3.

The view according to FIG. 4 with respect to FIG. 3 shows the blade profiling of the running blade ring 20 in connection with its rotating direction (arrow) and provides a good idea of the profiling and curvature of the guiding elements 37 advantageous with respect to the flow. A person skilled in the art can see that the recirculation discharge in the area of the upstream edge 35 of the ring chamber 29 in relation to the running blade ring 20 is to take place here with a counterswirl. Reference number 36 indicates the downstream edge of the ring chamber. It is pointed out again that, in simpler constructions, the guiding elements can also consist of plane or curved "metal sheets".

Figure 5:
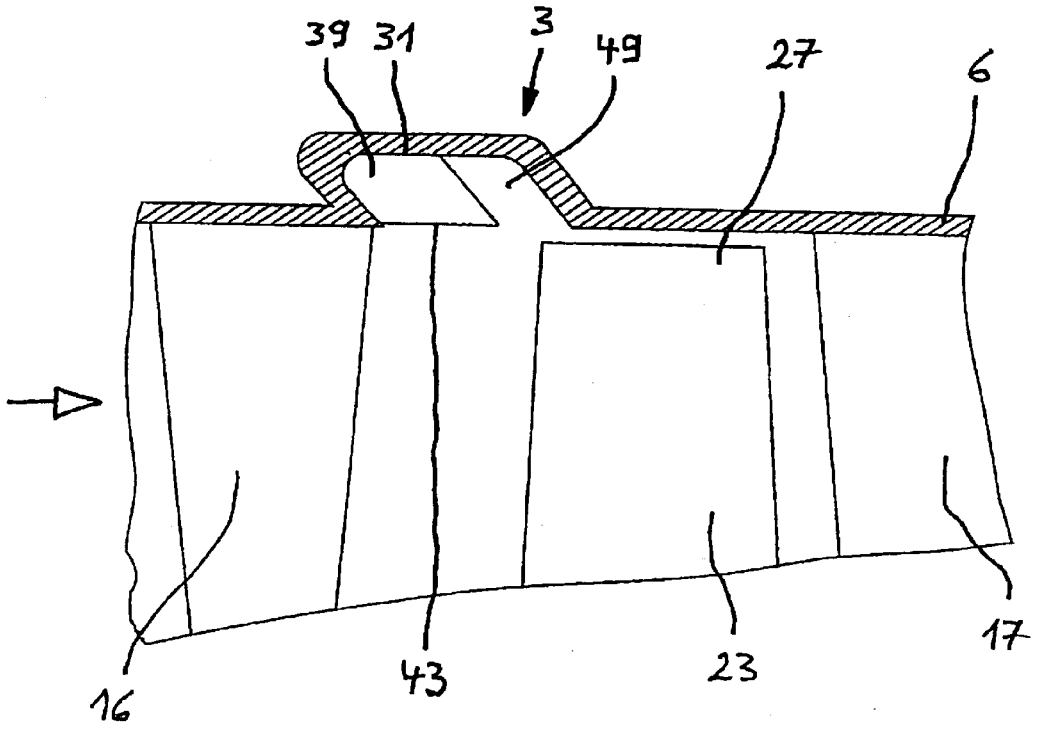
FIG. 5 is a partial longitudinal sectional view in the area of a casing-side recirculation structure modified in comparison to FIG. 1.

The recirculation structure 3 according to FIG. 5 is a "casing treatment" with a ring chamber 31 integrated in a casing 6. Here, the guiding elements 39 extend to the leading wall of the ring chamber 31; recesses 49 exist in the trailing area, in the direct proximity of the blade ends 27 of the running blade ring 23. The free edges 43 of the guiding elements 39 do not extend into the rotating range of the blade ends 27. Reference numbers 16 and 17 indicate the guide blade rings.

Figure 6:
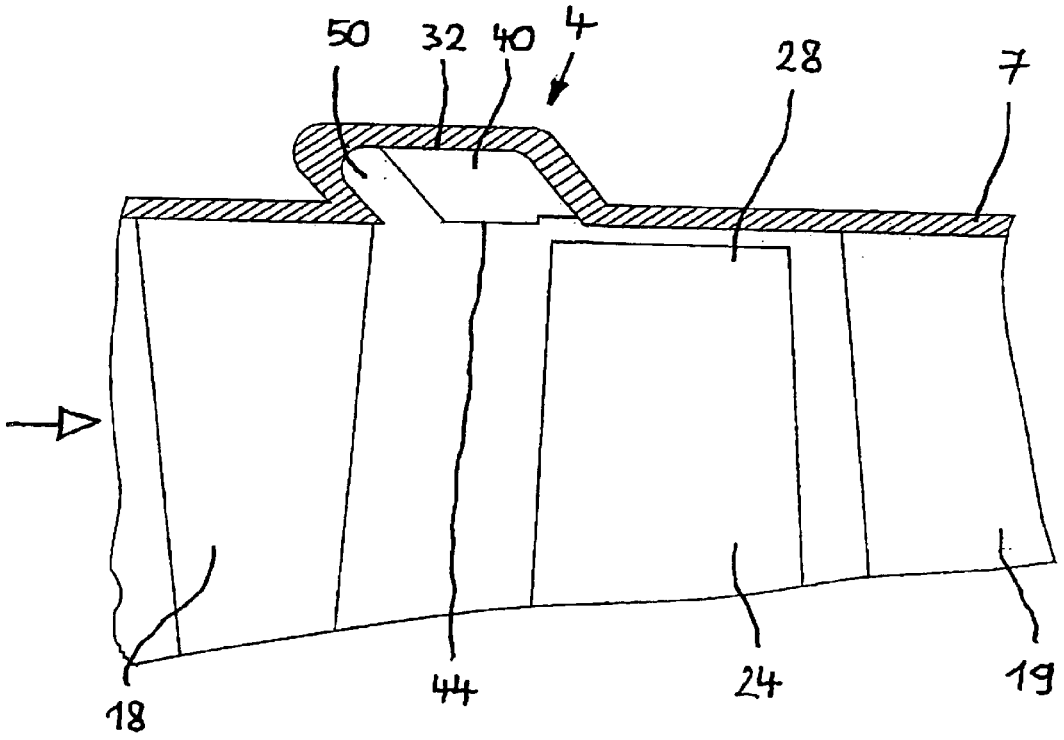
FIG. 6 is a partial longitudinal sectional view in the area of a casing-side recirculation structure modified in comparison to FIGS. 1 and 5.

The recirculation structure 4 in FIG. 6 with the ring chamber 32 and the guiding elements 40 is also a "casing treatment" which is integrated in a casing 7 and interacts with a running blade ring 24. In contrast to FIG. 5, here the guiding elements 40 extend to the trailing wall of the ring chamber 32. Recesses 50 are provided here in the leading area. Since the free edges 44 of the guiding elements 40 extend into the rotating range of the blade ends 28, they are radially offset toward the outside in the trailing area in order to securely avoid a contact with the blades. Naturally, the edges as a whole can also be correspondingly offset.

It applies to all embodiments of the recirculation structure that the free edges 41 to 44 of the guiding elements 37 to 40 must not be radially offset toward the outside if the guiding elements are made of a soft light metal or a plastic material because a contact with the blade ends 25 to 28 can be permitted without any damage to the blades.

What is claimed is:

1. Recirculation structure for a turbocompressor which has a compressor axis, an annular main flow duct surrounding the compressor axis, and a blade ring in the main flow duct, said recirculation structure comprising:

a ring chamber radially adjoining the main flow duct and opening to the main flow duct along an axial extent of the ring chamber and with axial ends of the ring chamber aligned with walls of the main flow duct, and a plurality of air guiding elements disposed in the ring chamber and configured to form a recirculation flow with air from the main flow duct entering the ring chamber at an axially downstream part of the ring chamber and exiting the ring chamber at an axially upstream part of the ring chamber with a defined swirl, said ring chamber being provided with an open axially extending recess at at least one axial end of said air guiding elements for accommodating air flow in a circumferential direction of the ring chamber, wherein an axial center of the ring chamber is disposed upstream of free radial ends of blades of the blade ring, and wherein said ring chamber is radially open to the main flow duct along substantially the entirety of the circumferential and axial extent of the ring chamber, and wherein free radial ends of the air guiding elements are substantially aligned with contours of the walls of the main flow duct which adjoin the ring chamber.

2. Recirculation structure according to claim 1, wherein said ring chamber is formed at a fixed casing of the main flow duct, and wherein said blade ring is rotatable with respect to the fixed casing.

3. Recirculation structure according to claim 1, wherein said ring chamber is formed at a rotatable hub, and wherein said blade ring is a fixed stator ring.

4. Recirculation structure according to claim 1, wherein said ring chamber is disposed in use in a single stage turbocompressor.

5. Recirculation structure according to claim 1, wherein said ring chamber is disposed in use in a multi-stage turbocompressor.

6. Recirculation structure according to claim 1, wherein said ring chamber is disposed in one of an axial, diagonal or radial turbocompressor.

7. Recirculation structure according to claim 1, wherein an axially leading wall and an axially trailing wall of the ring chamber, starting from its edges on the contour of the main flow duct, are sloped by a similar angle upstream diagonally toward a front of the ring chamber.

8. Recirculation structure according to claim 1, wherein an axially leading wall and an axially trailing wall of the ring chamber, starting from its edges on the contour of the main flow duct, are sloped by different angles upstream diagonally toward a front of the ring chamber.

9. Recirculation structure according to claim 7, wherein the angle of slope $\alpha$ of the axially leading and the axially trailing wall of the ring chamber, starting from the radial direction, has a value in the range of from 30° to 60°.

10. Recirculation structure according to claim 8, wherein the angle of slope $\alpha$ of the axially leading and the axially trailing wall of the ring chamber, starting from the radial direction, has a value in the range of from 30° to 60°.

11. Recirculation structure according to claim 1, wherein the air guiding elements are constructed in a metal-sheet-type manner to be flat or curved, of a constant thickness, or, in a blade-type manner, to be spatially curved, of a varying thickness and with defined sections.

12. Recirculation structure according to claim 1, wherein, in an axial viewing direction, the air guiding elements are arranged radially, sloped in the circumferential direction, or curved in the circumferential direction, in the case of a slope or a curvature, the angles $\beta$ being selected such that the entry of the recirculation flow into the ring chamber is fluidically facilitated, that is, takes place in a fluidically advantageous manner.

13. Recirculation structure according to claim 1, wherein the ratio of the total flow volume to the total volume of the guiding elements within the recirculation structure is selected to be maximal with the air guiding elements having a construction which is as thin-walled or thinly profiled as possible.

14. Recirculation structure according to claim 1, in which the guiding elements extend axially into an area of the free blade ends, wherein the free edges of the guiding elements, at least in the area of the free blade ends are radially set back so far that, in the normal operation of the turbocompressor, no contact takes place between the blade ends and the guiding elements.

15. Recirculation structure according to claim 1, wherein the guiding elements consist of metal, such as steel or of an Ni or a Co base alloy, a light metal, such as Al, or a plastic material, such as thermoplastics, duroplastics or elastomers.

16. Recirculation structure according to claim 15, wherein the free edges of the guiding elements in the case of light metal or plastic extend into the area of the free blade ends and a contact is possible.

17. Aircraft engine, comprising a turbocompressor with at least one recirculation structure according to claim 1.

18. Industrial gas turbine, comprising a turbocompressor with at least one recirculation structure according to claim 1.

19. A recirculation structure for turbocompressors, having an annular chamber arranged concentrically with a compressor axis in the area of free blade ends of a blade ring, the annular chamber radially adjoining a contour of a main flow duct, a side of the annular chamber adjoining the contour of the main flow duct being open to the main flow duct over its axial length and over its entire periphery, and having a plurality of guide elements, which are arranged in the annular chamber distributed over the periphery thereof, and which are arranged and shaped in a manner favorable to the inlet of recirculation flow in an axially rear area of the annular chamber and in such a way that the outlet of the recirculation flow in an axially front area of the annular chamber occurs with a defined direction and where appropriate a defined swirl in relation to the downstream blade ring, the guide elements in at least one of the front area and the rear area of the annular chamber having recesses for the passage of a flow in the peripheral direction, wherein free edges of the guide elements over their axial length lie on or close to the contour of the main flow duct, and wherein the axial center of the annular chamber lies upstream of the axial center of the free blade ends.

20. Recirculation structure according to claim 19, wherein said annular chamber is formed at a fixed casing of the main flow duct, and wherein said blade ring is rotatable with respect to the fixed casing.

21. Recirculation structure according to claim 19, wherein said ring chamber is formed at a rotatable hub, and wherein said blade ring is a fixed stator ring.

22. Recirculation structure according to claim 19, wherein said annular chamber is disposed in use in a single stage turbocompressor.

23. Recirculation structure according to claim 19, wherein said annular chamber is disposed in use in a multi-stage turbocompressor.

24. Recirculation structure according to claim 19, wherein said annular chamber is disposed in one of an axial, diagonal or radial turbocompressor.

25. Recirculation structure according to claim 19, wherein an axially leading wall and an axially trailing wall of the annular chamber, starting from its edges on the contour of the main flow duct, are sloped by a similar angle upstream diagonally toward a front of the ring chamber.

26. Recirculation structure according to claim 19 wherein an axially leading wall and an axially trailing wall of the ring chamber, starting from its edges on the contour of the main flow duct, are sloped by different angles upstream diagonally toward a front of the annular chamber.

27. Recirculation structure according to claim 25, wherein the angle of slope $\alpha$ of the axially leading and the axially trailing wall of the annular chamber, starting from the radial direction, has a value in the range of from 30° to 60°.

28. Recirculation structure according to claim 26, wherein the angle of slope $\alpha$ of the axially leading and the axially trailing wall of the annular chamber, starting from the radial direction, has a value in the range of from 30° to 60°.

29. Recirculation structure according to claim 19, wherein the air guiding elements are constructed in a metal-sheet-type manner to be flat or curved, of a constant thickness, or, in a blade-type manner, to be spatially curved, of a varying thickness and with defined sections.

30. Recirculation structure according to claim 19, wherein, in an axial viewing direction, the air guiding elements are arranged radially, sloped in the circumferential direction, or curved in the circumferential direction, in the case of a slope or a curvature, the angles β being selected such that the entry of the recirculation flow into the annular chamber is fluidically facilitated, that is, takes place in a fluidically advantageous manner.

31. Recirculation structure according to claim 19, wherein the ratio of the total flow volume to the total volume of the guiding elements within the recirculation structure is selected to be maximal with the air guiding elements having a construction which is as thin-walled or thinly profiled as possible.

32. Recirculation structure according to claim 19, in which the guiding elements extend axially into an area of the free blade ends, wherein the free edges of the guiding elements, at least in the area of the free blade ends are radially set back so far that, in the normal operation of the turbocompressor, no contact takes place between the blade ends and the guiding elements.

33. Recirculation structure according to claim 19, wherein the guiding elements consists of metal, such as steel or of an Ni or a Co base alloy, a light metal, such as Al, or a plastic material, such as thermoplastics, duroplastics or elastomers.

34. Recirculation structure according to claim 33, wherein the free edges of the guiding elements in the case of light metal or plastic extend into the area of the free blade ends and a contact is possible.

35. Aircraft engine, comprising a turbocompressor with at least one recirculation structure according to claim 19.

36. Industrial gas turbine, comprising a turbocompressor with at least one recirculation structure according to claim 19.

* * * * *